United States Patent [19]

Appleton

[11] Patent Number: 4,553,000

[45] Date of Patent: Nov. 12, 1985

[54] PLUG AND RECEPTACLE WITH SEPARABLE SWITCH CONTACTORS

[75] Inventor: Arthur I. Appleton, Miami Beach, Fla.

[73] Assignee: Appleton Electric Company, Chicago, Ill.

[21] Appl. No.: 551,285

[22] Filed: Nov. 14, 1983

[51] Int. Cl.[4] ..... H01H 9/20

[52] U.S. Cl. ..... 200/50 B; 200/51.09

[58] Field of Search ..... 200/50 B, 51.11, 51.17, 200/51.09

[56] References Cited

U.S. PATENT DOCUMENTS

| | | | |
|---|---|---|---|
| 1,528,681 | 3/1925 | Marth | 200/50 B |
| 1,818,290 | 8/1931 | Wulle | 200/50 B |
| 2,697,212 | 12/1954 | Castelli | 339/111 |
| 2,986,613 | 5/1961 | Figueira | 200/51.09 |
| 3,235,682 | 2/1966 | Papworth | 200/51.09 |
| 3,339,039 | 8/1967 | Daly | 200/51.09 |
| 3,374,449 | 3/1968 | Moore et al. | 333/97 |
| 3,585,323 | 6/1971 | Appleton et al. | 200/50 B |
| 3,598,941 | 8/1971 | Nelson | 200/51.09 |
| 3,599,167 | 8/1971 | Adrian et al. | 339/42 |
| 3,843,853 | 10/1974 | Panek et al. | 200/51.09 |
| 3,982,804 | 9/1976 | Marechal | 339/41 |

*Primary Examiner*—Harry E. Moose, Jr.
*Assistant Examiner*—Morris Ginsburg
*Attorney, Agent, or Firm*—Jon L. Liljequist

[57] ABSTRACT

A plug (10) carries terminals (38) which also act as switch contacts and which insert into a receptacle (12) with essentially zero insertion force. The receptacle also carries terminals (84) which similarily double as switch contacts. After insertion of the plug into the receptacle, the plug terminals and receptacle terminals are electrically bridged by electrical bridges (68) driven forward by actuator means (62, 122) which also doubles as an integral part of an interlock arrangement. A first bayonet type of polarizing means ensures that the plug will only insert into the receptacle in a single orientation, whereas a second polarizing means permits keying a given plug to a given receptacle. The combining of switch and interlock into a minimum of parts provides simplicity and interlock protection as well as creates an exceptionally compact design.

14 Claims, 13 Drawing Figures

PLUG AND RECEPTACLE WITH SEPARABLE SWITCH CONTACTORS

TECHNICAL FIELD

This invention relates broadly to those kinds of electrical devices that make non-permanent and relatively easily separable electrical connections between a power source and an electrical load. More particularly it relates to improved plug and receptacle connectors preferably for "power" rather than "control" applications and which are readily adaptable for use in hazardous locations if desired. In terms of objectives, the invention is concerned with reducing the size and complexity of power plug and receptacle devices, and also with making them easier to handle and use.

BACKGROUND ART

Most plug and receptacle combinations for power applications incorporate male pins as part of either the plug or the receptacle, and these are inserted into female sleeves in the other half of the plug and receptacle combination. However, to avoid any misunderstanding as to what is meant by the term "power" in this context, it relates to those applications where the connector is emplaced between the power source and the load so as to carry the bulk of the electrical current transmitted to the ultimate load, even if only a few amperes. Good electrical contact between pin and sleeve is usually achieved either by longitudinally splitting the pin and spreading those split portions slightly so that they compressively engage the female terminal when inserted therein, or alternatively, by longitudinally splitting the female and compressing the split portions slithly to achieve the same end objective. Several examples of these kinds of devices can be seen, for example, in U.S. Pat. No. 3,235,682 to Papworth and also in U.S. Pat. No. 3,585,323 to Appleton et al. As will be understood, the compressive contact between male and female terminals unfortunately causes a frictional force on the plug terminals tending to resist efforts to move the plug either into or out of mating engagement with the receptacle. And although this frictional resistance is reasonably small for very small plugs and receptacles, it increases to significant proportions as the electrical load transmitting capacity of the device increases. Conventional plug and receptacle devices capable of carrying as much as several hundred amperes or more become so bulky and difficult to manage that they may require several persons to insert the plug into the receptacle both because of the bulk of the plug (with its attached conductors) as well as because of the above mentioned frictional forces between male and female terminals that resist insertion. And, to avoid an even greater insertion force, the terminals are usually loosely mounted so that they center themselves upon insertion.

Beyond the traditionally popular pin and sleeve style of plug and receptacle terminals discussed above, another known but lesser used terminal design for plugs and receptacles incorporates butt contacts such as are shown, for example, in U.S. Pat. No. 3,982,804 to Marechal. In this construction the male terminals of the plug include butt contacts at their distal ends that engage receptacle butt contacts after substantial insertion of the plug into clearance holes provided therefor in the receptacle. However, although the Marechal design could have achieved a very low or perhaps even zero plug insertion force, at least over the initial and largest part of the insertion, that potential was never realized because the Marechal design utilizes the full plug insertion from start to finish to compress a spring within the receptacle. Compression of that spring is for the purpose of storing energy therein which is later utilized to facilitate a "quick break" of the male and female terminals to minimize the eroding effect of the arcs which are inevitably formed as electrical contact between the power transmitting butt contacts is broken. And although the Marechal device is technically a plug and receptacle because electrical contact is made directly between the plug and receptacle terminals by manually pushing the plug into the receptacle, the breaking of electrical contact is achieved by pushing a button which acts to release the compressed spring and cause the energy stored therein to drive the plug outwardly. Therefore, the physical act of breaking the circuit has considerable similarity with that of operating a pushbutton switch.

Other known electrical connectors also have a "quick-break" internal switching capability. For example, one of these other connectors is shown in U.S. Pat. No. 3,843,853 to Panek et al. Therein the pulling of an externally exposed pin or the melting of that pin, as caused by a buildup of heat therearound, automatically effects a disconnect of the internally connected, power transmitting terminals.

Where the power transmitted is relatively low, the mere physical act of pushing the plug into the receptacle is perhaps an acceptable technique in directly connecting the load with the power source. But, as the power rating of the plug and receptacle combination increases, it becomes increasingly desirable to provide some type of controlled switching arrangement within the body of the receptacle to both make and break contact consistently at optimum speed to thereby minimize arcing between the electrical contacts. Otherwise, for example, "diddling" of the contacts upon insertion will cause excessive damage thereto. Several ways of achieving a quick-make and quick-break are shown and described in various prior art. But because these devices usually position an internal switch in series with the plug and receptacle terminal connection, they tend to become excessively bulky, cumbersome, complex, and therefore, expensive.

For a variety of reasons it is also desirable to include polarizing means on plug and receptacle so that the plug will only insert into the receptacle at a given and predetermined axial orientation relative thereto. This ensures that the same male terminals always contact the same female terminals, which may be important, for example, depending upon whether the connector is wired for single or three phase current. Additionally, in the Marechal device described above, it is important that the plug housing always be at the same orientation relative to the receptacle housing when the power is connected so that external structure on the plug and receptacle housings will align and lock plug to receptacle against the full separation force of the compressed spring which would otherwise disengage them. Many power connectors utilize a conventional bayonet type of polarizing arrangement where by insertion of the plug is achieved by several distinct movements before the electrical connection is made. Initial insertion can only occur at a given angular orientation, but stops are encountered before electrical connection is made. However this initial insertion positions the plug for rotation (perhaps 45°) to an intermediary and semicaptivated position defined by other stops. In some plug and receptacle designs this completes insertion whereas in others there may be yet another and further insertion step (as in Marechal) to make electrical contact. In any event, rotation of the plug in many designs also rotates the female terminals, and because they are usually directed connected to the power cables, those cables by flexing necessarily resist this rotation.

Because several or more identical plugs and receptacles might be in use proximate one another, but set up for example to transmit different voltages, it is desireable to include other polarizing means within the plug and receptacle to key a given plug only to a given receptacle. This will prevent the insertion of that plug into the wrong receptacle which might thereby injure the electrical equipment to which the plug is attached.

Referring once again to the Marechal device, that design includes a form of modifiable polarizing means that can be preset to ensure that a given plug will only mate with a given receptacle. Before use, the plug is disassembled and the plug terminals are revolved some fraction of one revolution relative to the plug housing, and then they are fixed in that new position to the plug housing. By compatibly rotating the receptacle terminals and fixing them relative to the receptacle housing, only that plug and receptacle will mate with one another unless identical changes are made to other plugs and receptacles.

When used in hazardous locations, other design restraints are normally imposed on electrical connectors. By "hazardous locations" it is meant that the connector device is used in an environment of potentially explosive gas or the like such that an exposed arc created by making or breaking electrical contact could ignite the surrounding atmosphere and thereby jeopardize life or property or both. Any arc that could occur under these conditions is thus preferrably confined within an internal space inside the connector that is defined by a specially designed housing. That internal space is not necessarily sealed from the external environment, and it thus may "breathe in" the same explosive fumes as exist externally of the connector, however any internal explosion caused by an internal arc is quenched by the connector housing before the flame front can propogate outside of the housing to the outside atmosphere and thereby cause a much larger and more dangerous explosion. The added versatility of being able to use a plug and receptacle in hazardous locations as well as in ordinary locations is an obvious advantage.

Connector devices used in hazardous locations are not only frequently of pin and sleeve design, but may also be classified as being of "dead front" construction. In fact, at least one of the prior art patents mentioned earlier is of dead front design. This simply means that insertion of the plug into the receptacle engages the pins of the plug with the sleeves of the receptacle which are not at that time connected to the power source. Hence they are deemed electrically "dead". Therefore, the insertion of plug pins into electrically dead receptacle sleeves will not create an arc. Then, after this initial connection, the receptacle sleeves are electrically connected to the power source within an explosion proof chamber by any of a number of known ways. This arrangement is normally quite safe in a hazardous location, although it does tend to add size and complexity to the resulting device because, once again, significant space is consumed in the multiplicity of spaces needed for the dead front connection, for the series-connected internal power connection and for whatever supporting paraphernalia or features are also included.

Other mechanism also frequently designed into power plugs and receptacles having switches are various forms of interlocks that act either to lock the plug to the receptacle when the power is on, that act to permit the circuit to be opened or closed only when the plug is fully inserted, and so forth. These interlock arrangements normally consist of mechanism auxiliary to the switch itself, and usually they are exposed to the atmosphere so as to be physically and chemically vulnerable.

DISCLOSURE OF INVENTION

This invention integrates three highly desireable features into a single power plug and receptacle design: that of a power plug and receptacle having a quick-make and quick-break capability to minimize arcing, that of a power plug and receptacle design that permits insertion of the plug into the receptacle or withdrawal of the plug from the receptacle with minimal force, if any, and that of inherent simplicity both in the switching mechanism and in the interlock arrangement. The major objectives of the invention are to not only improve plugs and receptacles in each of these areas, but also to combine these features in a particularly compact package, even when embodied in an explosion proof design. In achieving these objectives, the invention adds and combines new concepts with old to create the new and superior connector design to be described, however it will be understood that each new feature alone also represents a significant improvement in itself and need not necessarily be combined with the others for advantages to be reaped.

Size reduction is achieved in part by eliminating the separate make-or-break switch frequently both contained within the receptacle body and connected in series with the plug and receptacle terminal. Instead, in this design, the plug itself comprises a part of the switch while the receptable comprises the rest, however activation or deactivation of this switch is accomplished by flipping a lever rather than by inserting or withdrawing the plug. In other words, the plug is fully inserted into the receptacle without its terminals ever coming into electrical contact with the receptacle terminals, nor does the plug or its terminals depress any springs. There is thus effectively no resistance to insertion of the plug. The plug is then rotated to a semi-captivation position, but this does not rotate the receptacle terminals and thus causes no resistance from power conductors attached thereto. Then, by flipping an external lever on the body of the receptacle, the terminals of the plug and the terminals of the receptable are electrically bridged to thereby connect the load to the power source. There is therefore no need for "dead front" construction nor is there any need for separate and internal switch means fully contained within the receptacle because the plug terminals and receptacle terminals themselves comprise the switch contacts. In essence, removal of the plug separates the switch into two distinct parts, and thus the contact surfaces on the plug and receptacle terminals, or "contactors", are fully separable.

The bridging operation that takes place within the receptacle is a bridging of butt contacts on both plug and receptacle terminals by means of a conductive bridge which consists of a connected pair of butt contacts similar to those on the terminals, but mounted on moveable actuator means. Therefore, the making or breaking of electrical contact between a plug terminal and a receptacle terminal occurs from plug terminal to bridge and simultaneously from bridge to receptacle terminal for a "double-make" or a "double-break". As is known in the art, a double-make or a double-break cuts the arc length in half from what it would be with a single make or break, and each half-arc thus has a lesser degrading effect on the terminal contacts. Furthermore, there is no need to loosely mount either the plug or the receptacle terminals so that they float and self align with one another.

The moveable actuator means includes a plurality of electrical bridges, one for each plug terminal and receptacle terminal to be bridged. These bridges are spaced around a dielectric wafer that forms a part of the actuator means, and this dielectric wafer need only be moved axially forwardly toward the plug a short distance to simultaneously, although indirectly, connect each plug terminal with the appropriate receptacle terminal. A second embodiment shows a differently configured dielectric wafer that rotates rather than translates to achieve a similar butt electrical contact between the various plug and receptacle terminals.

Of particular significance is the arrangement whereby the actuator means itself also includes the interlock that acts not only to lock the plug to the receptacle, but also acts to permit or prevent the switch from being turned on or off to connect or disconnect the load with the power source. This is a most significant feature because the entire interlock arrangement is created by the molded shape of the dielectric wafer and the various other elements with which it interacts. By having the interlock formed into the necessary switch parts, all of the desirable interlock features are achieved with essentially no additional parts, and this adds to the compactness, simplicity, reliability and low cost of the resulting product. Additionally, the interlock system is desireably contained within the interior of the receptacle so as to remain physically protected. And when the device is designed for explosion proof applications, the interlock is factory sealed automatically with the switch components because they are integrally one.

Operation of the plug and receptacle connector is exceedingly simple. Polarizing means on the plug and receptacle housings permit insertion of the plug into the receptacle in only one orientation (as is already well known) up to a first stop position. The plug is then rotated conventionally clockwise 45° where it snaps into a second stop position (which can be thought of as a "semi-captivation" position) by means of a detent arrangement. Essentially no force is required to push the plug into the receptacle, and very little torque is required to rotate it 45° to its second stop position of semi-captivation. An external lever on the receptacle is then pivoted, and by way of another portion of the actuator means, as for example a toggle mechanism connected directly thereto, an internal shaft forming yet another portion of the actuator means is thrust axially forwardly a short distance toward the plug. At its forward end, this actuating shaft carries other portions of the actuator means in the form of a dielectric wafer on which are mounted the electrical bridges which ultimately make and break the electrical connection. Upon moving forward, the dielectric wafer not only causes the electrical bridges to engage the terminals, but in its forward location it acts to obstruct reverse rotation of the plug back to its first stop position from which it could be withdrawn from the receptacle. Thus, the plug can only be withdrawn after the external switch lever is turned to its "off" position so as to eliminate the obstruction. This same structure in the receptacle also obstructs the actuator shaft from moving forwardly to its "on" position until after the plug is inserted into the receptacle and rotated to its position of semi-captivation.

Where the plug and receptacle connector is designed for hazardous locations, it will be of explosion proof design. The integrity of the internal explosion proof chamber is achieved as soon as the plug has been inserted to its first stop position and before it is rotated to its semi-captivation position, but until that latter time the interlock prevents the power from being turned on anyway.

The plug and receptacle of this invention also includes means by which a given plug can be keyed for use only with one or some limited number of receptacles. But, as opposed to the Marechal device, the plug and receptacle of this invention can be specially keyed to one another after they are installed in the field without removing the receptacle from the junction box or "back box" therebehind.

The invention also lends itself to the inclusion of other desireable features. For example, the actuator means is not limited to manual operation by way of the external lever. If desired, this external lever and the toggle mechanism connected thereto can be replaced by an electrically actuated solenoid or the like. And when so actuated, perhaps by an auxiliary control switch, that control switch can be located either on the receptacle, at the load or at some other desireable location.

Use of a solenoid provides other advantages as well. For example, either electrical or thermal or electronic sensing paraphernalia can easily be designed into the system to automatically signal the solenoid and interrupt the circuit to provide an overload protection feature. Additionally, the solenoid can be arranged to be activated or deactivated by remotely located pressure sensors, temperature sensors, and so forth.

There is thus disclosed herein a broad design philosophy for a plug and receptacle connector that teaches how to achieve insertion and withdrawal of the plug with essentially no resistance from the receptacle, that provides a quick-make and quick-break of the plug and the receptacle terminals without a completely separate and series-connected switch, and that also achieves several desireable interlock features integrated directly into the switching mechanism rather than auxiliary thereto such that the end device is particularly simple and compact. Stated another way, the resulting compactness is derived not only from making dual use of the internal actuator means, both as part of the switching means and as part of the interlock, but also by combining the two space consuming and series arranged electrical connections normally found in these kinds of connectors, specifically that connection where the plug pin terminals insert into the receptacle sleeve terminals and also that connection within the receptacle where the receptacle terminals are electrically engaged with the power source. The design also includes several plug and receptacle polarizing arrangements, lends itself to explosion proof design, can include electrically actuated operation, may be arranged to provide overload protection or can turn itself off responsive to other types of sensors. Furthermore, the receptacle can be "factory sealed".

As will be appreciated by a close examination of the prior art, the addition of each new and desirable feature to a given connector usually increases the connector's size and complexity. However, the inventive concepts of this disclosure have simultaneously combined a plurality of features into a simple and exceedingly compact configuration, without self-defeating compromises, and with a resulting synergism heretofore not seen, at least not in the earlier cited prior art.

DETAILED DESCRIPTION OF THE DRAWINGS

Figure 1:
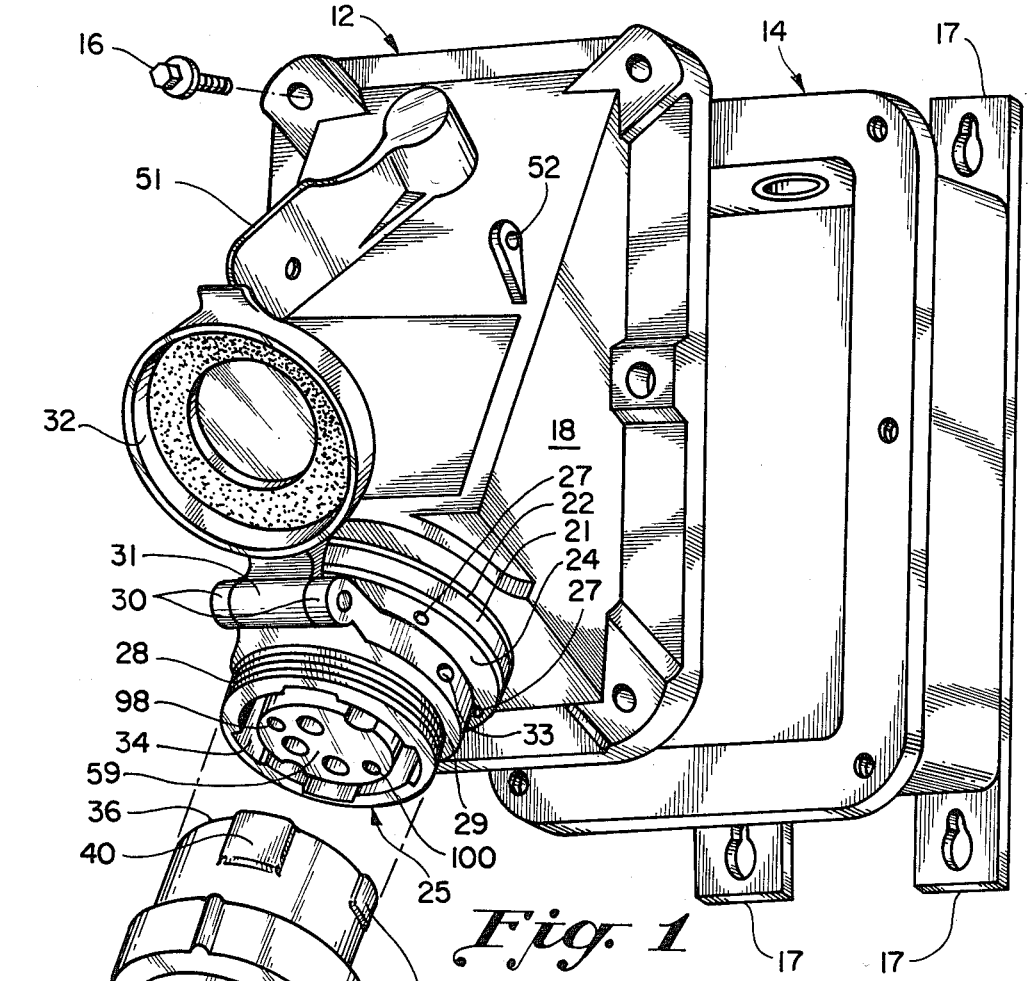
FIG. 1 is a perspective view of a plug and receptacle incorporating the principles of the present invention, along with a back box, all three items being shown spaced apart from one another, but in their proper relative locations for connection to one another.
Figure 2:
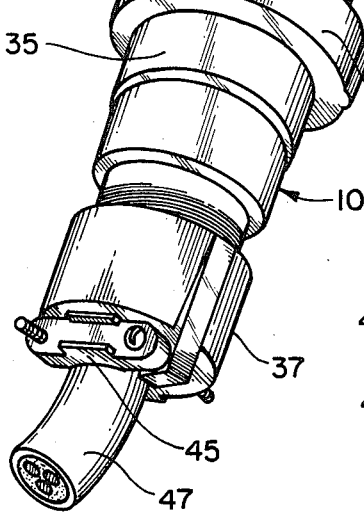
FIG. 2 is a perspective view of the plug alone looking partially into the front end of the plug to show the plug terminals and various polarizing means.
Figure 2:
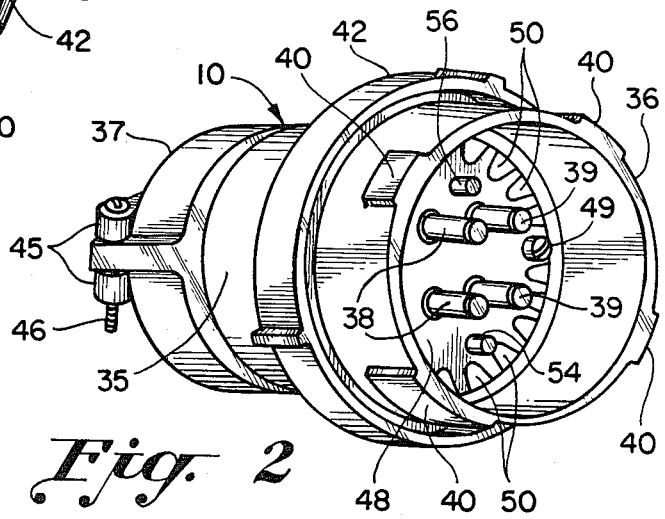

Referring now to the drawings in detail, and initially to the perspective views of FIGS. 1 and 2, the invention is shown embodied in an explosion proof plug and receptacle designated generally 10 and 12, respectively. The rear end of the receptacle 12 is mounted onto a back box designated generally at 14 by way of a plurality of six screws, one being shown at 16, and the back box 14 can be conventionally mounted on a vertical surface by way of a plurality of ears 17 affixed thereto and having holes therethrough for receiving fasteners, not shown. As is conventional with many power plugs and receptacles, particularly those suitable for servicing heavier loads, the plug 10 inserts upwardly into the front end of the receptacle at an angle of perhaps 30° with the vertical.

Figure 3:
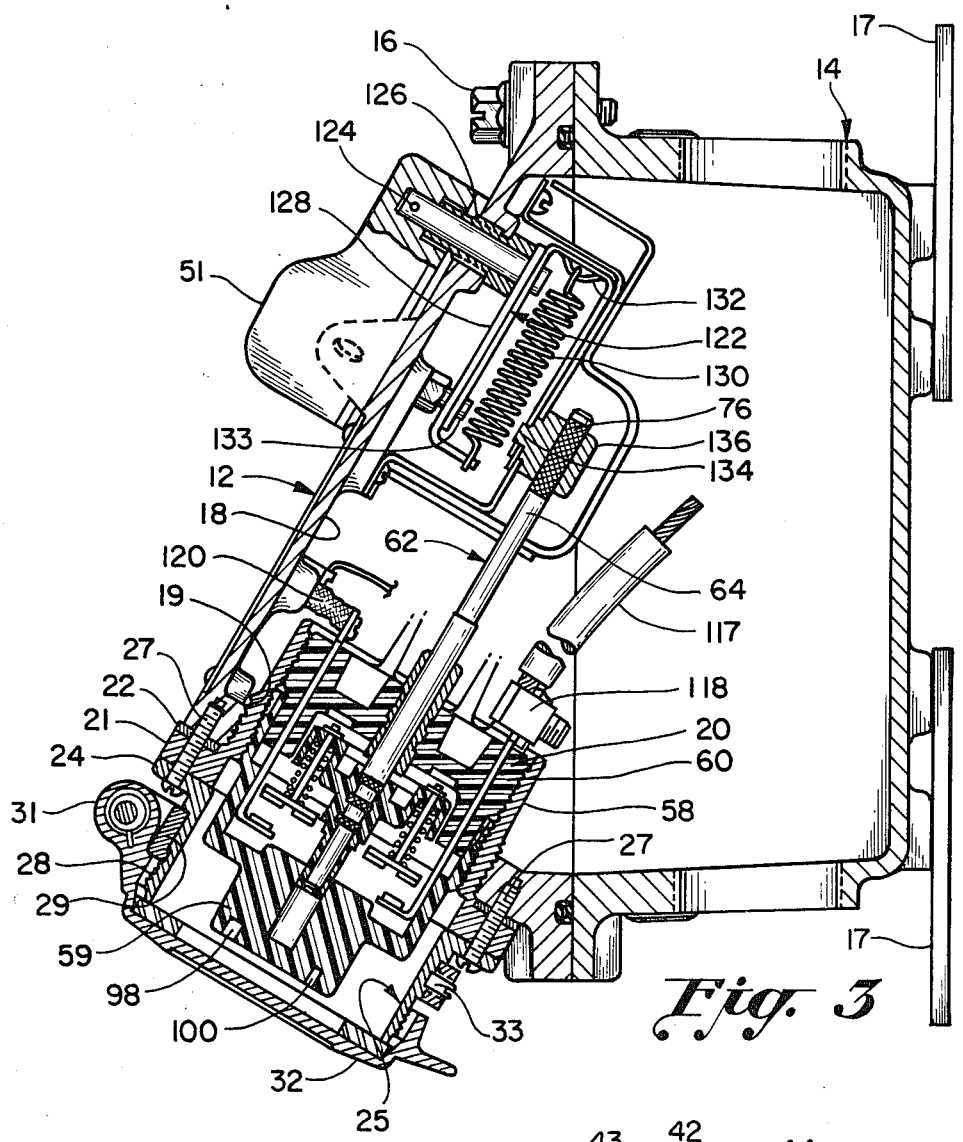
FIG. 3 is a vertical cross-sectional view of the receptacle and back box of FIG. 1 assembled together, but with the cover biased closed.
Figure 4:
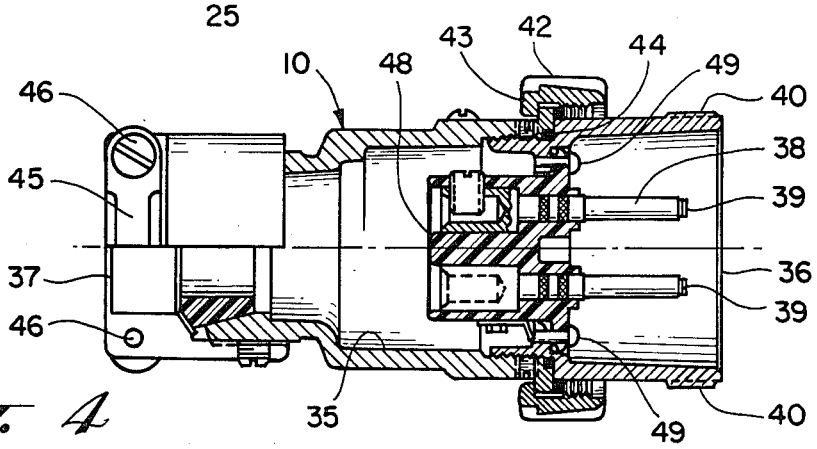
FIG. 4 is a cross-sectional view of the plug shown in FIGS. 1 and 2.

Receptacle 12 includes a housing 18 having a lower, front end to which and in which is mounted the receptacle portions of the switch, interlock and polarizing means. With reference particularly to FIG. 3 which includes reference numbers primarily to the overall configuration of the receptacle, it can be seen that the lower front end of housing 18 is internally threaded as at 19, and screwedly mounted into threads 19 from the outside front of the housing is an assembly generally 20 made up of both conductive and dielectric parts that form both the interlock and receptacle portions of the switch. This assembly 20, to be discussed in greater detail later, is screwed into housing threads 19 until its outermost flange 21 snugs up against a washer-shaped elastomeric seal 22 between it and the housing, and also with four evenly spaced holes 23 around the flange 21 (best seen in FIGS. 5 and 6) in alignment with four threaded holes in housing 18 so that it can later be secured thereto.

Mounted entirely externally of housing 18 and against flange 21 is the flange portion 24 of a polarizing sleeve designated generally 25. Flange 24 has four holes 26 therethrough (best seen in FIGS. 5 and 6) in alignment both with the four holes 23 in flange 21 and also with the four holes in the lower front of the receptacle housing 18. Four screws 27 (FIGS. 1 and 3) extending through both flanges and into the threaded housing holes lock assembly 20 and polarizing sleeve 25 to the receptacle housing 18.

The forward cylindrical portions of sleeve 25 are externally threaded as at 28 for receiving an internally threaded and mating ring 29. Ring 29 includes a pair of outwardly extending ears 30 that hingedly support the complimentary hinge portions 31 of a cover 32 that is normally biased by a spring (not visible because it is carried inside hinge portions 31) to close off the open front end of the polarizing sleeve 25. After ring 29 is screwed up the proper distance over polarizing sleeve 25, and with ears 30 positioned forwardly and upwardly, a set screw 33 on the side of ring 29 is tightened to lock the ring in place. The inner surface of polarizing sleeve 25 includes a plurality of polarizing slots 34 which cooperate with the plug 10 to permit its insertion at only one angular orientation around its longitudinal axis.

The plug 10 includes a housing 35 having a front end 36 that mates with the lower front end of the receptacle, and it also includes a rear end 37. The front end 35 is of tubular shape and protectively surrounds a plurality of plug terminals 38 that project forwardly therefrom to their distal ends which carry butt contacts 39 thereon of a suitable contact material such as silver cadmium oxide. The tubular front end 35 of the plug is conventionally of a size that will axially slide into the annular gap between polarizing sleeve 25 and assembly 20. However, as noted earlier, it will only slide therein when the plug 10 is properly oriented angularly around its longitudinal axis, and this is achieved by a plurality of polarizing pads 40 (spaced around the outer surface of tubular front end 35) that interfit with the polarizing slots 34 of receptacle polarizing sleeve 25. And by making one of the pads 40 and one of the slots 34 larger than the rest, the plug will only insert at one specific angular orientation.

Plug 10 also conventionally includes a loose collar 42 that is internally threaded for engagement with threads 28 on the receptacle polarizing sleeve 25. The rear end of collar 42 has an inwardly directed flange 43 that engages an outwardly directed flange 44 on the plug so as to permit one to securely affix the plug 10 to the receptacle 12. The rear end 36 of the plug conventionally carries a clamp 45 along with tightening screws 46 for securely clamping a multi-cable conductor 47 thereto which internally carries the conductors that are connected to the plug terminals 38 conventionally by way of terminal lugs contained within the body of the plug. Terminals 38 are molded into a terminal block 48 which is secured in the plug housing by means of two screws 49. Screws 49 extend through two diametrically opposed holes in terminal block 48 which are created by punching through two of twenty-four reduced wall thickness indentations 50 (see FIG. 2) spaced 15° apart around terminal block 48.

Pivotally mounted externally on the receptacle housing 18 is a lever 51 shown in its "off" position in FIGS. 1 and 3. This lever can be pivoted generally counterclockwise from one stop (not visible) against which it is resting in those figures to a second stop 52 which defines its "on" position, but it will only activate the switch and stay in this position when the plug 10 is fully inserted into the receptacle and is rotated 45° clockwise.

In FIG. 2 it will be seen that the plug 10 not only carries the four forwardly extending plug terminals 38, but it also includes two forwardly extending locator pins 54 and 56. These locator pins 54 and 56 cooperate with a pair of mating holes at the front end of receptacle assembly 20 and comprise additional polarizing means, to be described in greater detail later.

The bulk of the invention is contained within receptacle 12 and is largely embodied within the limited number of parts making up assembly 20. These parts are perhaps most easily understood with reference to FIGS. 5 and 6 and include receptacle switch sleeve 58, front insulation block 59, rear insulation block 60 and a portion of the actuator means in the form of a wafer subassembly designated generally 62. This combination of parts plus polarizing sleeve 25 is shown not only in FIGS. 5 and 6, but is also shown in cross-section in FIGS. 11 and 12, and also in FIG. 3 but without reference numbers because of limited space.

Figure 9:
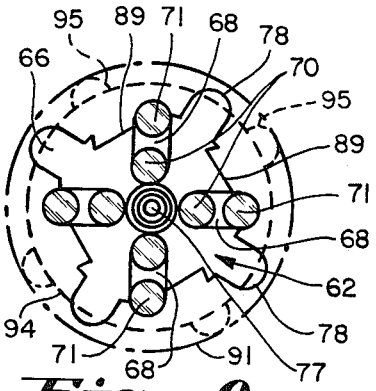
FIG. 9 is a front end view of the wafer subassembly, this view also including in dashed lines the outline of cooperating interlock structure of the front insulation block.
Figure 10:
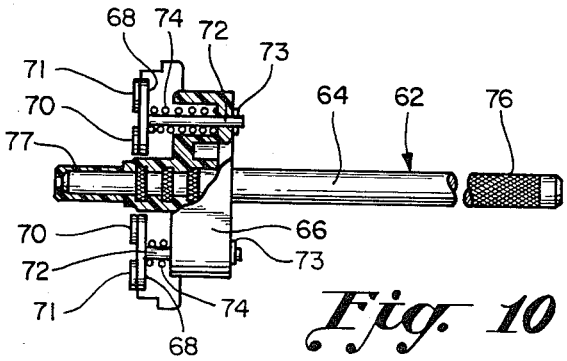
FIG. 10 is a side elevation of the wafer subassembly shown in FIG. 9.

Wafer subassembly 62 (shown alone in FIGS. 9 and 10) includes an actuator shaft 64 insert-molded into a dielectric wafer 66. Dielectric wafer 66 carries four alongated electrical bridges 68 equally spaced therearound, and each electrical bridge 68 carries an inner butt contact 70 and an outer butt contact 71 thereon facing generally forwardly. Each electrical bridge is mounted at its center to a rearwardly extending shaft 72 that extends through a clearance hold in the wafer with an E-ring 73 therebehind to captivate the bridge and permit only limited forward and rearward movement relative to the wafer 66, and each bridge is biased forwardly by means of a spring 74. The rear end of actuator shaft 64 is knurled as at 76, and the leading end 77 of the wafer subassembly comprises a centering pin that slides within a centering hole in front insulation block 59. Dielectric wafer 66 also includes four laterally outwardly extending ears 78 that play a key function in the interlock arrangement to be described later.

Figure 7:
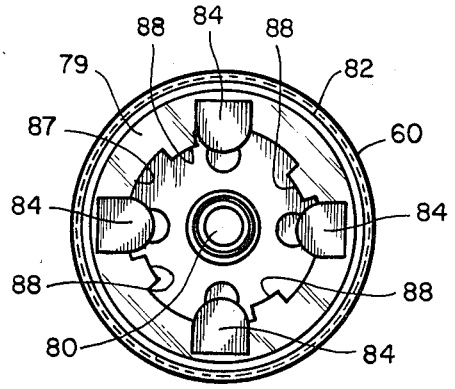
FIG. 7 is a front end view of the rear insulation block in which the wafer subassembly is moveably mounted.
Figure 8:
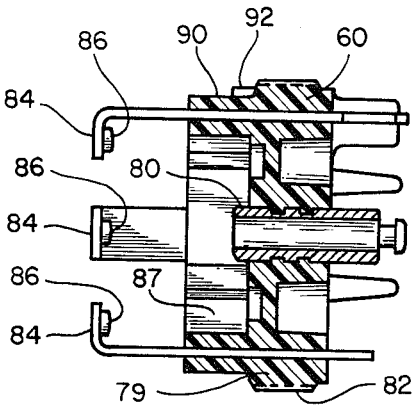
FIG. 8 is a side elevation of the rear insulation block of FIG. 7.

The wafer subassembly 62 is designed to be carried in and captivated by rear insulation block 60. FIGS. 7 and 8 show the rear insulation block along, while FIGS. 3, 5, 6, 11 and 12 show the rear insulation block with the wafer subassembly captivated therein. Referring to FIGS. 7 and 8, rear insulation block 60 includes a dielectric main body 79 with a central metallic bushing 80 insert molded therein. Its periphery includes external threads 82, and between bushing 80 and threads 82 are four L-shaped and conductive terminals 84. Terminals 84 are evenly spaced around the dielectric main body, project forwardly therefrom, have their front distal ends bent inwardly with a butt contact 86 facing rearwardly on each inwardly bent portion, and they pass entirely through the dielectric main body 79 so as to extend rearwardly beyond its rearmost portions.

In moveably captivating wafer subassembly 62 in rear insulation block 60 this being done as a separate preassembly operation, the knurled end 76 of shaft 64 is pushed rearwardly through the axial hole of bushing 80, and the dielectric wafer 66 is then properly angularly oriented relative to the four L-shaped terminals 84 so as to be able to be moved rearwardly past them. Bridges 68 are all simultaneously depressed by means of a fixture (not shown) against the bias of springs 74, so that wafer 66 and bridges 68 can be compressed axially, and then these portions of the subassembly 62 are rotated under the inwardly bent portions of L-shaped terminals 84 such that butt contacts 71 on bridges 68 lie directly behind butt contacts 86 of L-shaped terminals 84. Then the springs 74 are released from the fixture which causes butt contacts 71 to push against butt contacts 86 and thereby force rear portions of the dielectric wafer 66 backward into a recess 87 (FIGS. 7 and 8) in the rear insulation block 60. After the wafer subassembly 62 is mounted in rear insulation block 60, it can only reciprocate relative thereto for a short distance forwardly and rearwardly. Relative rotation around their common longitudinal axis is inhibited by four inwardly jutting splines 88 of rear insulation block 60 that fit into mating longitudinal grooves 89 on the dielectric wafer 66 itself. Subassembly 62 is thus restrictively captivated within rear insulation block 60.

Figure 6:
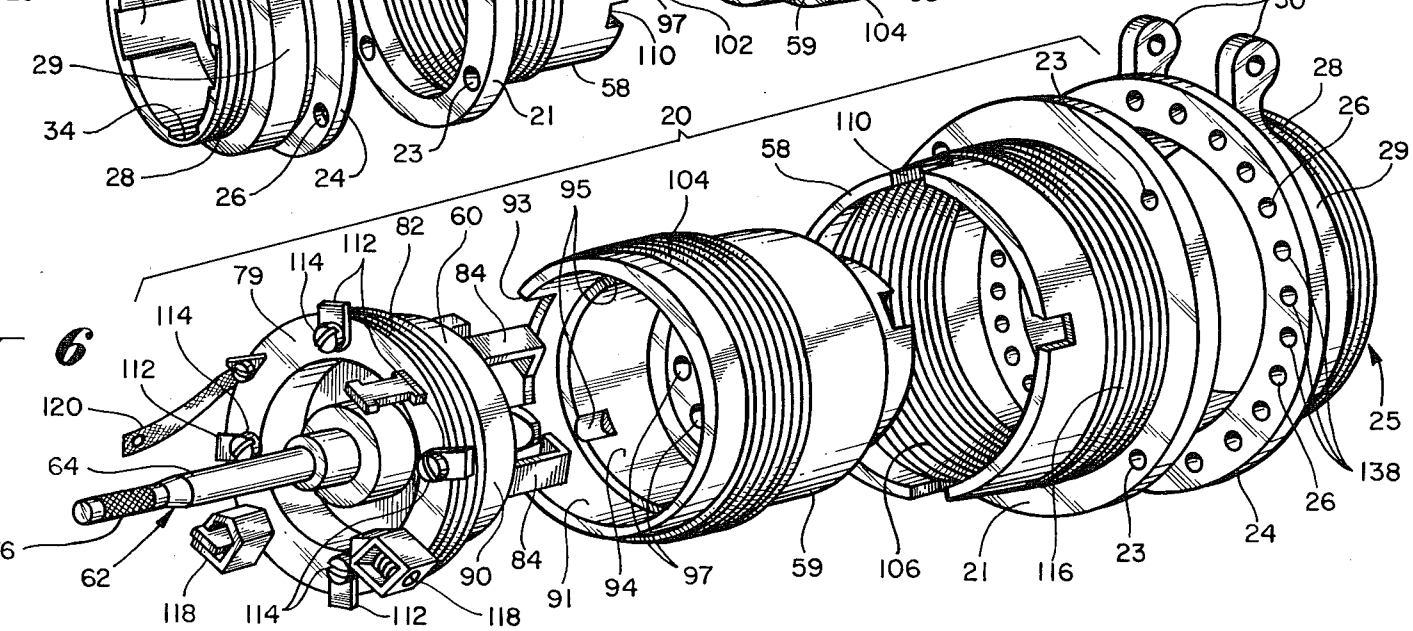
FIG. 6 is another exploded perspective view of the components shown in FIG. 5, this view showing in part the rear ends of these components.

As can perhaps be most clearly understood with reference in part to FIG. 6, portions of the rear insulation block 60 that extend forwardly of external threads 82 include a cylindrical surface 90 that fits internally within a closely mating internal surface 91 at the rear of front insulation blocks 59. After being fully inserted therein, relative rotation between the rear insulation block and the front insulation block is limited to 45° by way of an integrally molded stop 92 (also see FIG. 8) on the rear insulation block 60 that fits within a circumferentially wider cut-out portion 93 at the rear of front insulation block 59.

Preferably the plug and receptacle includes a detent arrangement whereby rotation of front insulation block 59 to one of its two extreme angular positions causes it to be defeatably held therein. One effective and compact arrangement comprises providing surface 90 with a pair of diametrically opposed holes, each carrying a compression spring and ball, that cooperate with four spaced and diametrically opposed indentations in surface 91 (these details not being visible in the drawings).

Ahead of cylindrical surface 91 within front insulation block 59 is another internal cylindrical surface 94 (see FIGS. 6, 11 and 12) of lesser diameter than cylindrical surface 91 thus forming a shoulder 96, of lesser diameter than the distance across each diametrically opposed pair of ears 78 of dielectric wafer 66. However this lesser diameter is relieved back by means of grooves 95 to the greater diameter of surface 91 in four limited and equally spaced locations (see FIGS. 6 and 9).

Front insulation block 69 includes four clearance holes 97 in its front surface for receiving plug terminals 38, a large blind guide-hole 98 and a small blind guide-hole 100 in its front surface for receiving plug locator pins 54 and 56, respectively, and also front peripheral relief in the form of two indentations 102 for the otherwise interfering plug-terminal mounting screws 49 in the plug. Front insulation block 59 also includes external threads 104 of identical size and shape as the external threads 82 on rear insulation block 60 so that when the rear and front insulation blocks 60 and 59 are axially mated together, threads 82 and 104 are adjacent and together screw into internal threads 106 within the receptacle switch sleeve 58. This captivates the two insulation blocks together inside the receptacle switch sleeve 58. After screwing them as far as they will advance into the receptacle switch sleeve, they are then backed off sufficiently until four evenly spaced and threaded screw holes on the rear side of rear block 60 align with four notches 110 on the rear of receptacle switch sleeve 58, and then four lugs 112 that protrude radially outwardly are positioned within these notches 110 and then are drawn up tight in the screw holes by means of screws 114 to lock the rear insulation block 60 to the receptacle switch sleeve 58. This completes the assembly 22 which carries external threads 116 peripherally therearound on receptacle sleeve 58 for the purpose of screwing the assembly 22 into the threads 21 in the receptacle housing 20. And, as will be understood, front insulation block 59 is still capable of rotating 45° back and forth relative to rear insulation block 60 even after the assembly 22 is mounted in the receptacle housing and secured in place with screws 27.

Power brought into the back box 14 by way of conductors (such as seen at 117 in FIG. 3) is electrically connected to the rear ends of L-shaped terminals 84 by way of standard wire-connecting lugs 118. Three of the terminals 84 carry such lugs for connection to the electrical conductors, and the fourth terminal is grounded to the housing 20 by means of a conductive strap 120.

Wafer subassembly 62 has been earlier described as moveable forwardly and rearwardly a short distance, this being the movement needed to perform the switching function. Movement of the wafer subassembly 62 forwardly and rearwardly is achieved through a "toggle" of "over-center spring" mechanism generally 122 (see FIG. 3) which also forms a part of the actuator means. Such mechanisms are well known in switch construction, and thus a plurality of figures showing mechanism 122 is not deemed necessary. Suffice it to say that lever 51 (see FIG. 3) exterior of housing 20 is connected to a shaft 124 which is journaled on an explosion proof bushing 126 and which also extends into the housing 20 where it is connected to a first link 128. Link 128 is attached at its other or moveable end to a spring 130 preloaded in tension and arranged for over-center operation. At its other or upper end, spring 130 is connected to the pivotal end of a U-shaped link 132 having one lower leg that is free to pivot on a first pin 133 and another lower leg in which is journaled the pin portion 134 of a clamp 136. Clamp 136 is clamped securely around the knurled portion 76 of actuator shaft 64. By shifting lever 51 from the position shown in FIGS. 1 and 3 to its "on" position against stop 52, link 132 swings "over-center" (across pin 133) rendering link 132 unstable so as to pivot around pin 133 causing pin 134 (which is not in axial alignment with pin 133) to shift forwardly driving actuator shaft 64 similarly forwardly toward the plug. The butt contacts on bridges 68 thereby bridge the butt contacts on the appropriate plug and receptacle terminals to complete the circuit. And, presuming the plug remains in the receptacle, flipping the lever 51 back to its original position as seen in FIG. 1 will cause the over-center spring 130 to drive shaft 64 in the opposite direction so as to open the circuit. Toggle mechanism similar to that shown at 122 are so well known in the electrical switch art that further discussion relative thereto is not here warranted.

In some applications it may be desirable to replace toggle mechanism 122 with a solenoid so as to electrically drive shaft 64 forwardly and rearwardly. A control switch for the solenoid could be mounted on the receptacle, or alternately, at some remote location such as at the load. A solenoid offers some advantages as well. For example, overload sensors could be installed to trigger the solenoid and interrupt the circuit if the load becomes dangerously high. Also, proximate or remote sensors for pressure or temperature could similarly disconnect the power when those parameters extend beyond allowable limits.

A discussion of the operation of the invention will begin with the operation of the interlock system of the receptacle without the plug inserted therein. Lever 51 is therefore in its "off" position, and the wafer subassembly 62 is in its rearmost position as shown, for example, in FIG. 3. Under these conditions, if one were to grasp lever 51 and attempt to rotate it toward stop 52, it would swing through that arc and spring 130 of toggle mechanism 122 would swing over-center past pin 133 causing a forwardly directed force to be exerted on wafer subassembly 62. However, wafer subassembly 62 is prevented from moving forwardly because its dielectric wafer ears 78 will abutt the internal shoulder 96 within front insulation block 59. However, if the wafer ears 78 happened to be in angular alignment with the four grooves 95 in front insulation block 59, wafer subassembly 62 would be moveable forwardly, but they are not so aligned when the plug is not in the receptacle. Thus, although the spring 130 urges the wafer subassembly 62 toward its "on" position, the fact that the wafer subassembly cannot move forwardly causes spring 130 to return lever 51 to its "off" position as soon as it is released. This capability of the lever to swing to its "on" position without remaining there is an advantage because, if it were prevented from so moving, it might be forced and thereby cause injury to the mechanism.

To activate the switch, it is first necessary to insert the plug 10. Plug 10 will only insert into the receptacle at one angular orientation relative to its longitudinal axis because one of the pads 40 at the plug front end 35 is larger than the other three pads 40, and only one of the slots 34 in the receptacle front end is large enough to accept this larger pad. At this time the four clearance holes 97 are aligned with the four plug terminals 38. The receptacle 12 thus provides no resistance to insertion of the plug, and when fully inserted, the butt contacts 39 on plug terminals 38 have made no contact with any receptacle components. Thus, full insertion encounters essentially no resistance.

After this initial insertion, up to what is herein referred to as a "first stop" position, the plug can be rotated only clockwise (as viewed in FIG. 1) a maximum of approximately 45° to a second stop position which is herein terms its "semi-captivation" position. Pads 40 on the plug and polarizing slots 34 on the receptacle do not prevent rotation of the plug after it is fully inserted because polarizing sleeve 25 is undercut to the same internal diameter as slots 34 to permit rotation, however the reduced diameter portions of sleeve 25 between slots 34 prevent withdrawal of the plug from its position of semi-captivation. As the plug rotates, it also rotates front insulation block 59 therewith. There is essentially no resistance to this rotation except for overcoming the resistance of the internal detent that holds front insulation block 59 in its first stop position, but this is deemed an advantage because the detents make it obvious to the user that the plug has reached one of its two extreme positions, and they also hold it there. It will be recalled that the molded stop 92 on rear insulation block 60 fits within a larger cut-out or relieved portion 93 on front insulation block 59. Since only front insulation block 59 of assembly 22 can rotate, this rotation is limited to 45° by virtue of the interaction of molded stop 92 moving within the radially larger cut-out portion 93 of front insulation block 59.

Once the plug has been rotated 45° to its position of semi-captivation, and with front insulation block 59 carried along with that rotation, the internal grooves 95 within the front insulation block now align axially with the wafer ears 78 on the wafer subassembly 62. Thus, when lever 51 is pivoted counterclockwise to stop 52, the forward pressure exerted on shaft 64 by the toggle mechanism 122 causes the wafer subassembly 62 to snap forwardly with wafer ears 78 moving forwardly into grooves 95. As will be understood, spring 130 stabilizes in this overcenter position and continues to exert a forward force on the wafer subassembly 62.

Figure 11:
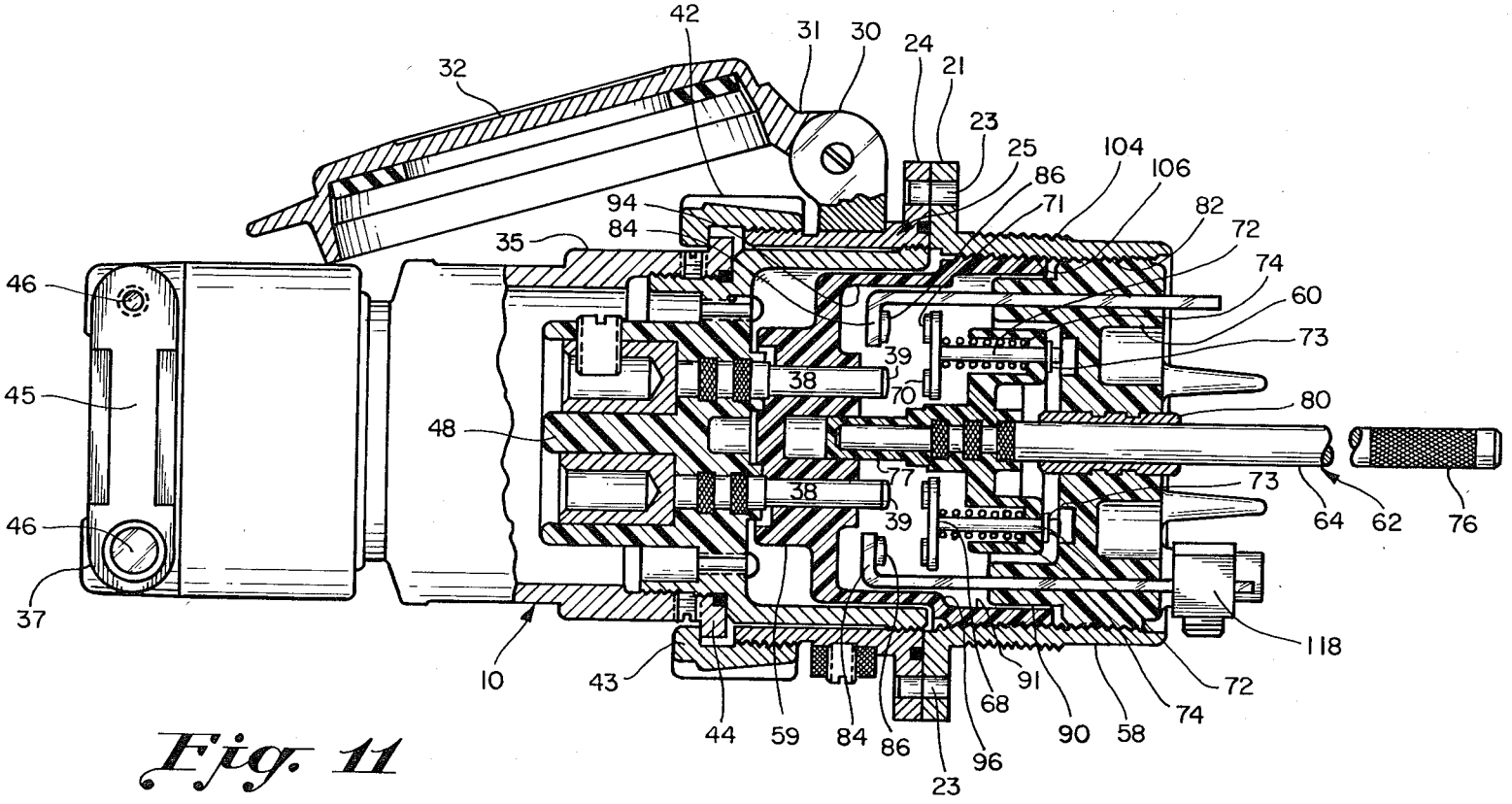
FIG. 11 is a partial cross-sectional view of a plug fully inserted into the FIGS. 5 and 6 components of the receptacle, but with the plug terminals out of electrical contact with the receptacle terminals.
Figure 12:
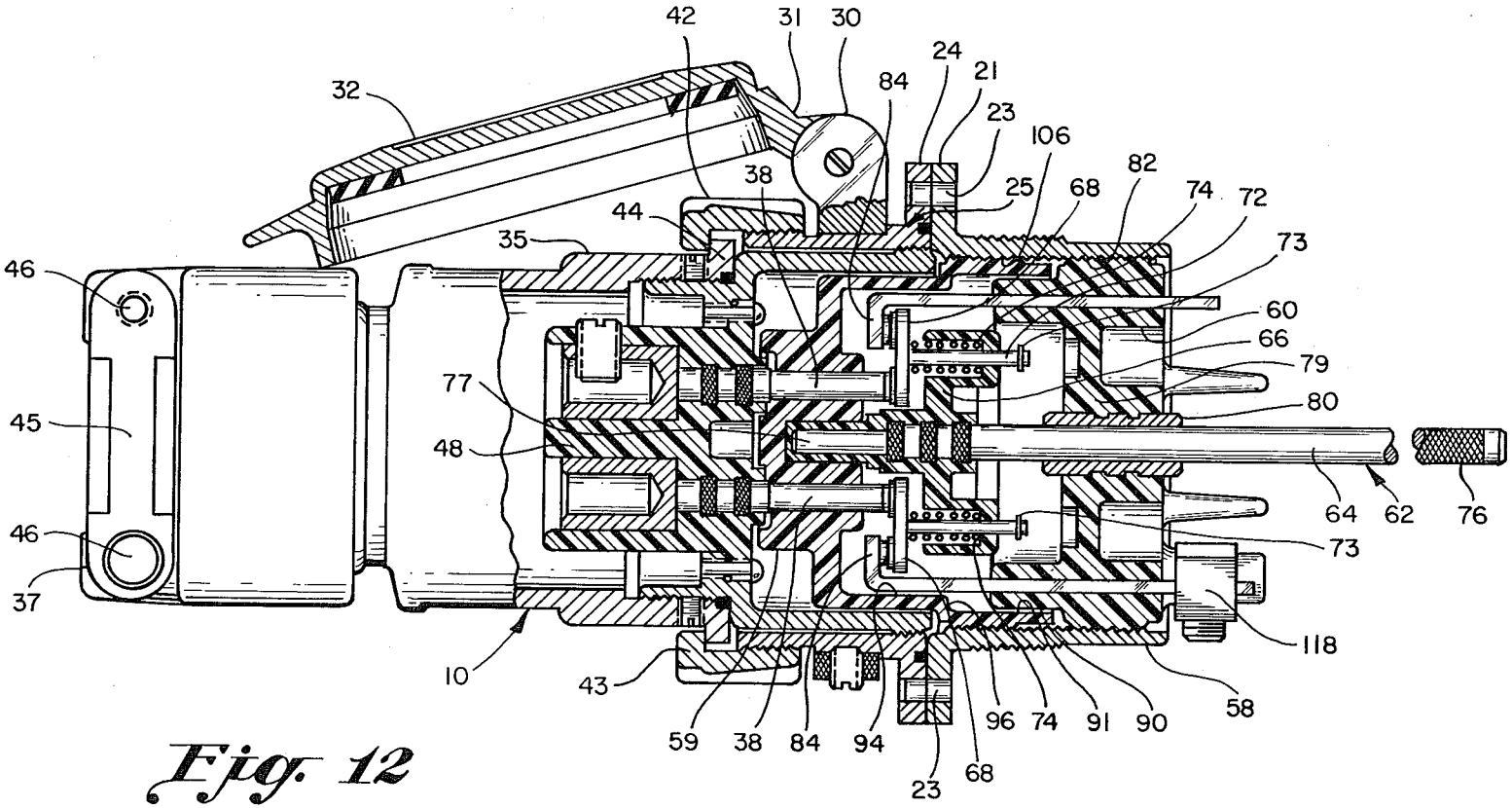
FIG. 12 is a cross-sectional view similar to FIG. 11, however the switch has been actuated such that the plug terminals and receptacle terminals have been electrically connected.

In FIG. 11 it can be seen that the wafer subassembly 62 is in its rearmost position corresponding to the lever 51 being in its "off" position, however the plug has been rotated to its semicaptivation position so that the plug and receptacle terminals are axially aligned. It will be noted that the plug terminals 38 are in electrical contact neither with the L-shaped receptacle terminals 84 nor with bridges 68. Thus, the switch is "open". In FIG. 12 the wafer subassembly 62 has been driven forwardly (to the left) under the influence of spring 130 as a result of rotating lever 51 clockwise until it engages stop 52. When this occurs, electrical bridges 68 are also driven forwardly so as to electrically bridge plus terminals 38 with receptacle terminals 84. As will be understood, butt contacts 70 on the electrical bridges 68 engage butt contacts 39 on plug terminals 38, and simultaneously, butt contacts 71 on the electrical bridges 68 contact butt contacts 86 on receptacle terminals 84. This causes a "double-make", and thus any arc formed is split in half by virtue of the double-make and is therefore not as destructive of the butt contacts. Also, the distance actuator shaft 64 moves forwardly is slightly greater than the initial distance between the terminal contacts and the bridge contacts so that springs 74 behind the bridges 68 depress and maintain pressure between the engaged butt contacts. And by mounting bridges 68 loosely on shafts 72 the compressive loading of springs 74 is evenly distributed between the plug and receptacle terminals.

When the switch is in its "on" position, the plug is fully captivated because it cannot be rotated back to its first stop position. The reason for this is that the wafer ears 78 are contained within the grooves 95 of the front insulation block 59. Since the wafer cannot rotate within the rear insulation block by virtue of the splines 88, and because wafer ears 78 reside within the grooves 95 in the front insulation block 59, front insulation block 59 is angularly captivated as long as wafer ears 78 remain in grooves 95. Thus, the same wafer subassembly that bridges the plug and receptacle terminals to make the circuit when pushed forwardly also integrally forms the interlock mechanism.

When lever 51 is returned to its "off" position, wafer subassembly 62 snaps rearwardly causing a desireable "double-break" of plug terminals 38 and receptacle terminals 84. Wafer ears 78 simultaneously withdraw from grooves 95, and this frees front insulation block 59 from being angularly locked to having limited angular freedom so that it can be rotated back to its first stop position preparatory to removing the plug 10 from the receptacle 12, if desired.

In a given installation where several or more of this style plug and receptacle are used, it may be desirable to provide means by which a given plug will only insert into a given receptacle. Thus, other polarizing means are built into this plug and receptacle to achieve this end.

It will be recalled that when the pads 40 on plug 10 appropriately align with the polarizing slots 34 on polarizing sleeve 26 of the receptacle, plug terminals 38 also align with clearance holes 97 in front insulation block 59. Therefore, plug terminals 38 are fixed at a specific angular orientation relative to pads 40, this being achieved by screws 49. Similarly, the front insulation block 59 must bear a particular angular relationship both with the rear insulation block 60 and with the polarizing sleeve 25. This is assured when holes 26 in the polarizing sleeve 25 align with holes 23 in the receptacle switch sleeve 58, and also when lugs 112 on rear insulation block 60 are located in notches 110 of the receptacle switch sleeve. This ensures that all plugs of a given amperage rating will mate with any receptacle of the same amperage rating. But if it is desired to key one plug with one receptacle only, these orientations must be consistently altered on that plug and receptacle. This is achieved by punching out two different scolloped indentations 50 from the plug terminal block 48 so that when the terminal block is secured to the plug housing by means of screws 49, it will cause the plug terminals to be angularly displaced relative to clearance holes 97. Therefore, the modified plug will not mate with a conventional production receptacle.

Figure 5:
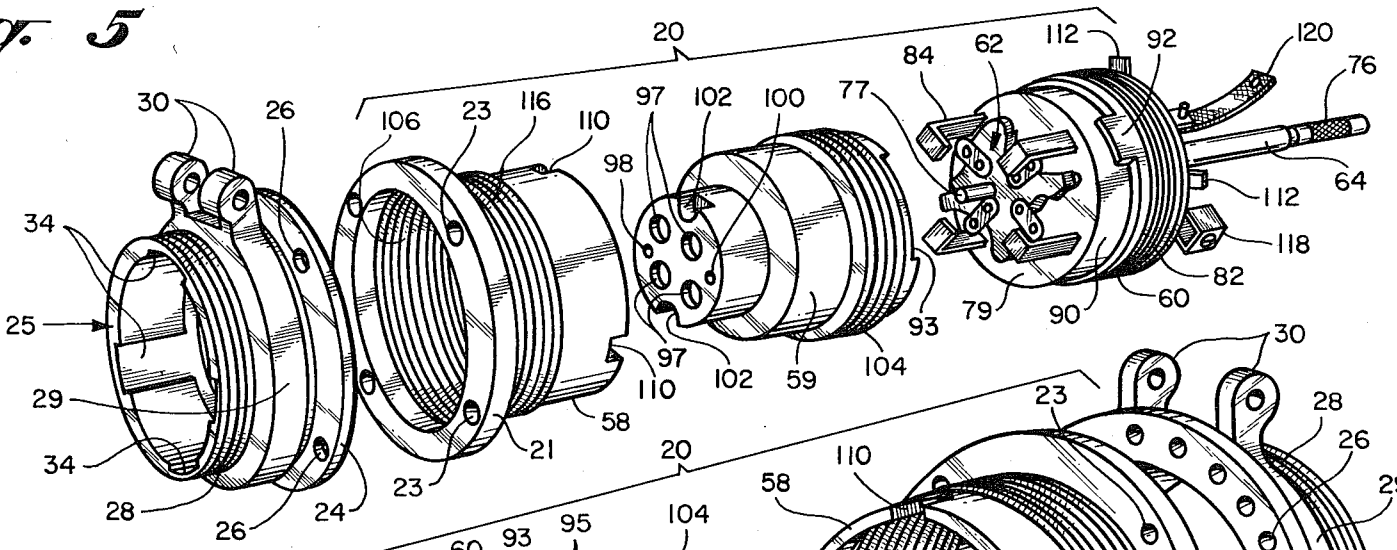
FIG. 5 is an exploded perspective view of the major switch and interlock components of the receptacle including the receptacle portion of the polarizing means, this view showing in part the front ends of these components.

To prepare the receptacle to receive the re-polarized plug, polarizing sleeve 26 must be compatibly rotated so that the polarizing slots 34 therein will align with plugs pads 40 concurrently with the alignment of plug terminals 38 with receptacle clearance holes 97. To explain this, reference is made to FIG. 6 wherein it can be seen that the rear surface of the flange portion 25 of polarizing sleeve 26 includes 24 die cast "blind" holes 138 equally spaced at 15° increments therearound. Four of these holes 138, however, have been drilled entirely through and once drilled comprise the four holes 26 that are also visible from the front of flange 25 as can be seen in FIG. 5. Preferably the holes 138 will carry adjacent thereto some lettering or numeral indicia consistent with similar indicia on plug terminal block 48 to simplify determining which holes 138 of the polarizing sleeve correspond to a given pair of indentations 50 in the plug terminal 48.

When a plug and receptacle are properly polarized to mate with one another, the large locator pin 54 (see FIG. 2) will mate with the large guide hole 98 in the front insulation block 59 while the small plug locator pin 56 will mate with the small guide hole 100. The guide pins and locator holes are included because the four terminals 38 are arranged symmetrically around the plug's longitudinal centerline, and some differently keyed plugs and receptacles might otherwise compatibly interfit. For example, if the plug terminals 38 of a second plug are polarized 90°, 180° or 270° from those of the proper plug for a given receptacle, the second or wrong plug would insert into the receptacle. However, with the large and small locator pins and holes, this obstructs that symmetry so that the plug 10 will only insert into the receptacle 12 intended therefor.

Figure 13:
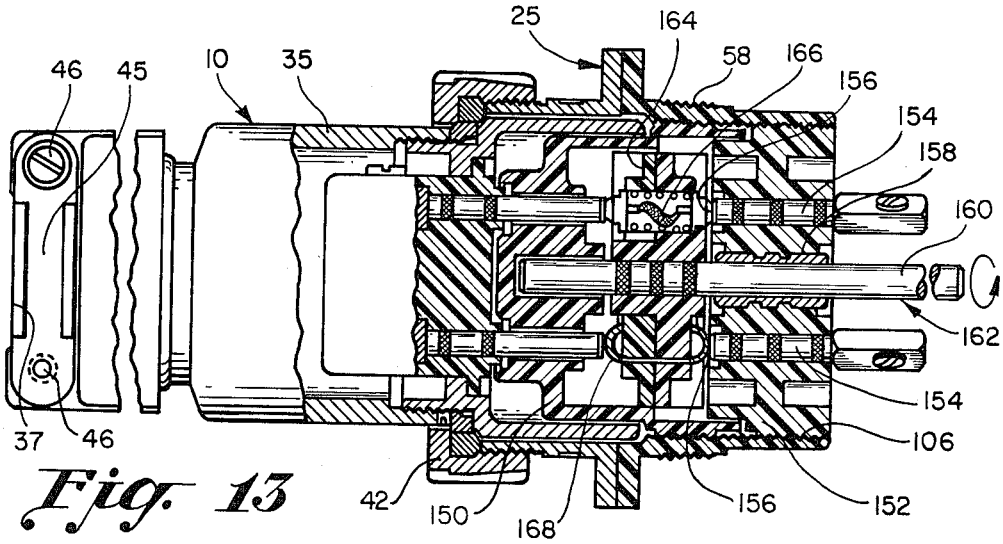
FIG. 13 is a partial cross-sectional view (similar to FIGS. 11 and 12) of the plug inserted into the front end of portions of a modified embodiment of the invention.

FIG. 13 is a view similar to FIG. 12 of the earlier described embodiment. The plug of FIG. 13 is identical in all respects to the earlier described plug, and it thus carries the same reference numbers as the plug of the earlier embodiment. Similarly, the receptacle polarizing sleeve 26 and the receptacle switch sleeve 58 are also identical to the corresponding parts in the earlier described embodiment and therefor also carry the same reference numbers. The differences lie within those parts captivated within receptacle switch sleeve 58, and therefore these parts carry different reference numbers.

In a manner similar to the earlier embodiment, receptacle switch sleeve 58 includes internal threads 106 that captivate a front insulation block 150 and a rear insulation block 152. Rear insulation block 152 has a plurality of receptacle terminals 154 molded therein with a butt contact 156 at the forwardmost end. Rear insulation block 152 also includes a central bushing 158 with an axial hole therethrough for guiding the rotating shaft portion 160 of a wafer subassembly designated generally 162. Shaft 160 is knurled near its leading end and has molded thereon a dielectric wafer 164 which captivatingly carries a plurality of electrical bridges. The upper bridge is designated 166 and includes a pair of butt contacts connected together with a flexible conductor, these butt contacts being axially biased outwardly by means of a spring. The lower electrical bridge is designated 168 and consists simply of a piece of conductive material bent in a generally C-shaped configuration. In a production receptacle these bridges would be identical, but two styles are here shown merely to illustrate various designs.

In this embodiment, the plug could be inserted with zero insertion force to a position with the plug terminals and receptacle terminals in axial alignment. Alternatively, it could be inserted and then rotated a partial revolution until the terminals align. In either event, the electrical bridges 166 and 168 are initially not in alignment with either set of terminals, but rather are thereafter brought into alignment to bridge plug terminals with receptacle terminals by rotating shaft 160. Once in alignment, the resilience of the bridges maintains the necessary electrical contact, and of course, provides a double-make or double-break design.

It is emphasised that this disclosure contains a number of independently usable, yet mutually supportive, concepts. The grouping of two or more into one design will reap multiple advantages, but this should in no way be construed to diminish the individual value of each improvement if chosen to be used alone in a given application. The figures are sufficiently detailed to enable those skilled in this art to employ whatever part of these teachings they choose into their own designs, but details not germane to the invention have been deliberately excluded from many of the drawings in order to increase the scale of the drawings so as to better focus on the inventive concepts. And merely because some device does not physically resemble the drawings herein does not necessarily mean that it has not benefited from these teachings. Therefore, the true breadth or scope of the invention is not to be defined and limited by the few drawings selected to representatively illustrate its principals, but rather by the language used by the claims when given its broadest, reasonable interpretation.

INDUSTRIAL APPLICABILITY

This invention has application wherever a plug and receptacle is used between an electrical load and a source of electrical power, however its value increases as the amount of power increases, as a result largely of the zero insertion force feature as well as the quick-make and quick-break feature.

Where electrical codes require disconnect switches within a relatively short distance from plugs and receptacles, the invention satisfies this requirement within the plug and receptacle itself.

And where safety dictates that a plug and receptacle installation be explosion proof in design, the invention can readily be adapted to include this feature as was shown in the drawings. Furthermore, where electrical equipment is best shut down when threatening conditions are present, the invention can be equipped with a solonoid controlled by any one or more of a variety of control switches or circuits.

I claim:

1. An electrical connector including a plug and receptacle for connecting an electrical load to a power source, said plug including a housing having a front end and a rear end with a plurality of terminals proximate its front end, said receptacle including a housing having a plug receiving end with means therein for receiving said plug terminals, said receptacle also including receptacle terminals, the improvement comprising:

said plug terminals, during and after full insertion into the receptacle, being spaced from said receptacle terminals so as to avoid resistance to insertion thereby;

and multiple function actuator means forming a part of one of said plug and receptacle which is moveable from a first position to a second position, but only when said plug terminals are fully inserted into the receptacle, for indirectly connecting said plug terminals and receptacle terminals electrically after the plug is fully inserted into the receptacle.

2. The improved connector as set forth in claim 1, wherein said plug terminals project forwardly relative to said plug front end and wherein said receptacle plug receiving end includes unobstructed clearance for said plug terminals to a depth in excess of the maximum penetration of the plug terminals, said plug being rotatable thereafter to semi-captivation position where the plug terminals remain spaced from the receptacle terminals, but are then aligned for an electrical bridging therebetween.

3. The connector as set forth in claim 1, wherein said actuator means includes a plurality of electrical bridges that electrically interconnect specific plug terminals with specific receptacle terminals, each electrical bridge including a pair of spaced apart contact surfaces that move with other portions of said actuator means selectively into and out of substantially simultaneous contact with both a plug terminal and a receptacle terminal.

4. The connector as set forth in claim 3, wherein said electrical bridges form a part of a subassembly that is selectively translatable forwardly and rearwardly between a first position and a second position, said first position locating said contact surfaces against the plug and receptacle terminals and said second position locating said contact surfaces away from said terminals.

5. The connector as set forth in claim 3, wherein said electrical bridges form a part of a subassembly that is selectively rotatable between a first position and a second position, said first position locating said contact surfaces against said terminals and said second position holding said contact surfaces away from said terminals.

6. In a plug and receptacle combination wherein the plug includes a plurality of plug terminals and the receptacle includes a plurality of receptacle terminals that are ultimately electrically connected to the plug terminals in individual pairs, said plug and receptacle also including switch means, the improvement comprising:

actuator means having a subassembly that moves as a unit both for selectively effecting electrical continuity and discontinuity between the plug terminals and receptacle terminals and also for interlocking the plug and receptacle during their connection, said plug and receptacle being so arranged that the plug terminals cannot come into electrical continuity with any current carrying receptacle terminal during insertion of the plug into the receptacle.

7. The plug and receptacle of claim 6, wherein said subassembly includes a dielectric component carrying a plurality of electrical contacts thereon to effect said connection, and also including portions integral therewith that interfit with other structure on one of said plug and receptacle only after said plug is fully inserted to thereby permit the switch means to effect said connection.

8. The plug and receptacle of claim 7, wherein said electrical contacts are arranged in electrically connected pairs, each pair comprising an electrical bridge that moves selectively to engage and disengage one of the plug terminals and one of the receptacle terminals to thereby effect a "double-make" and "double-break" of those terminals, respectively.

9. The plug and receptacle of claim 8, wherein the plug terminals comprise forwardly extending, parallel pin terminals each carrying a butt contact at its distal end, wherein the receptacle terminals each carry a butt contact in juxtiposition with one butt contact on the plug terminals, and wherein the electrical bridge carries two electrically connected butt contacts capable of simultaneously and electrically engaging and disengaging the juxtipositioned plug and receptacle butt contacts as desired.

10. In a power plug and receptacle combination having a switching capability, each of said plug and receptacle including a plurality of electrical terminals, each of said plug terminals being prearranged to electrically connect with a specific receptacle terminal to form a plurality of pairs of connectable plug and receptacle terminals, the improvement comprising:

structural means forming an integral part of said receptacle for unobstructedly and fully receiving the plug therein with essentially no resistance to the plug's full insertion, portions of each of the plug's terminals being fully contained within the receptacle after said full insertion;

an electrical bridge for each plug and receptacle terminal pair, each bridge being contained within the receptacle proximate a specific pair, one bridge interacting with each pair when the plug is fully inserted into the receptacle, actuator means for substantially simultaneously effecting an electrical connection between all terminal pairs, said actuator means carrying said electrical bridges therewith;

and means for moving said actuator means to selectively engage and disengage said bridges.

11. The power plug and receptacle combination of claim 10 including a back box to which the receptacle is mounted, said combination also including means for selectively keying a given plug to a given receptacle without removing the receptacle from the back box whereby only a selected number of plug and receptacle combinations carrying that specific keying will mate.

12. The power plug and receptacle combination of claim 10, wherein said receptacle includes a housing, a front insulation block and a rear insulation block, said front insulation block being rotatable from a first position to a second position after the plug is fully inserted therein, said rear insulation block carrying the receptacle terminals and being fixed relative to said housing whereby rotation of the plug in the front insulation block generates no movement of the receptacle terminals.

13. The power plug and receptacle combination of claim 10, wherein the electrical bridges are mounted on portions of a moveable subassembly, said portions being constructed of dielectric material, said subassembly additionally carrying portions of an interlock that moves generally with the electrical bridges, said interlock portions interacting with other structure on said combination to prevent withdrawal of the plug from the receptacle while the bridges effect an electrical connection between plug and receptacle terminals.

14. An explosion proof plug and receptacle comprising:

a plug having a housing defining a front end and a rear end, said front end carrying polarizing means, said plug also including a plurality of male terminals, each projecting forwardly therefrom to a distal end defined by a butt contact;

a receptacle having a housing with a plug receiving end having polarizing means for interacting with the plug polarizing means, said receptacle also including a front insulation block and a rear insulation block defining a switching void therebetween, said front insulation block having holes therethrough providing passages for the plug butt contacts to enter into said switching void;

a plurality of receptacle terminals carried by the rear insulation block, each terminal extending into said void and carrying a butt contact thereon;

actuator means carried in the receptacle having a moveable subassembly both for electrically connecting plug terminals with receptable terminals and for interlocking plug and receptacle when the plug terminals and receptacle terminals are electrically connected, said moveable subassembly carrying a conductive bridging element for each plug terminal and receptacle terminal to be electrically connected, each bridging element including two butt contacts of which one engages a plug terminal butt contact and the other generally simultaneously engages a receptacle terminal butt contact when the subassembly is moved from an "off" position to an "on" position, this simultaneous engagement effecting a double-make electrical connection;

said actuator means also including biasing means for exerting a force on said subassembly and cause it to respond quickly and achieve a quick-break electrical connection to hold down are degradation of the butt contacts.

* * * * *